US011737547B2

(12) United States Patent
Autié et al.

(10) Patent No.: US 11,737,547 B2
(45) Date of Patent: Aug. 29, 2023

(54) DEVICE FOR PACKAGING AND APPLYING A COSMETIC PRODUCT

(71) Applicant: PARFUMS CHRISTIAN DIOR, Paris (FR)

(72) Inventors: Noël Autié, Thiais (FR); Rodolphe Da Rovaré, La Garenne Colombes (FR)

(73) Assignee: PARFUMS CHRISTIAN DIOR, Paris (FR)

( * ) Notice: Subject to any disclaimer, the term of this patent is extended or adjusted under 35 U.S.C. 154(b) by 126 days.

(21) Appl. No.: 17/263,790

(22) PCT Filed: Jul. 16, 2019

(86) PCT No.: PCT/FR2019/051774
§ 371 (c)(1),
(2) Date: Jan. 27, 2021

(87) PCT Pub. No.: WO2020/021182
PCT Pub. Date: Jan. 30, 2020

(65) Prior Publication Data

US 2021/0289920 A1 Sep. 23, 2021

(30) Foreign Application Priority Data

Jul. 27, 2018 (FR) ..... 18 57046

(51) Int. Cl.
*A45D 40/06* (2006.01)
*A45D 40/00* (2006.01)

(52) U.S. Cl.
CPC ..... *A45D 40/06* (2013.01); *A45D 2040/0062* (2013.01); *A45D 2200/051* (2013.01)

(58) Field of Classification Search
CPC ..... A45D 40/06; A45D 40/065
See application file for complete search history.

(56) References Cited

U.S. PATENT DOCUMENTS 5,277,508 A 1/1994 Gueret
6,623,199 B2 * 9/2003 Naramoto ..... A45C 13/008 401/98

(Continued)

FOREIGN PATENT DOCUMENTS

EP 1197162 A2 4/2002
EP 1293146 A2 3/2003

(Continued)

OTHER PUBLICATIONS

International Search Report related to PCT Application No. PCT/FR2019/051774 dated Jan. 14, 2020.

*Primary Examiner* — Jennifer C Chiang
(74) *Attorney, Agent, or Firm* — von Briesen & Roper, s.c.

(57) ABSTRACT

A device for packaging and applying a cosmetic product comprises a mechanism for receiving a stick of cosmetic product, a base cover forming a first housing for receiving a first portion of the mechanism, a first seal between an element of the base cover and an element of the mechanism, and a cap fixed on the base cover in order to define a second housing receiving a second portion of the mechanism. A second seal is provided between the cap and said element of the base cover and/or said element of the mechanism. The first and second housings are connected in a sealed manner by the element of the base cover and/or the element of the mechanism.

25 Claims, 10 Drawing Sheets

(56) References Cited

U.S. PATENT DOCUMENTS

| | | | | |
|---|---|---|---|---|
| 7,553,101 | B2 * | 6/2009 | Harano | A45D 40/12<br>401/98 |
| 8,651,759 | B2 * | 2/2014 | Takahashi | A45D 40/00<br>206/385 |
| 2008/0296318 | A1 | 12/2008 | Chevalier | |
| 2014/0061198 | A1 | 3/2014 | Seguin et al. | |

FOREIGN PATENT DOCUMENTS

| | | | | |
|---|---|---|---|---|
| EP | 1719432 | A1 | | 11/2006 |
| FR | 2759555 | A1 | | 8/1998 |
| JP | S5913483 | U | | 1/1984 |
| JP | 09121938 | A | | 5/1997 |
| JP | H09182620 | A | | 7/1997 |
| KR | 20170030266 | A | * | 3/2017 |

* cited by examiner

DEVICE FOR PACKAGING AND APPLYING A COSMETIC PRODUCT

CROSS-REFERENCE TO RELATED APPLICATION

This Application is a 35 USC § 371 US National Stage filing of International Application No. PCT/FR2019/051774 filed on Jul. 16, 2019 and claims priority under the Paris Convention to French Patent Application No. 18 57046 filed on Jul. 27, 2018.

FIELD OF THE DISCLOSURE

The present invention relates to a device for packaging and applying a cosmetic product, notably a solid cosmetic product in stick form. The invention relates also to a mechanism for a device for packaging and applying a cosmetic product in stick form.

PRIOR ART

In the field of cosmetic products in stick form, such as lipsticks, for example, a device for packaging and applying the cosmetic product essentially comprises a base cover, a cap and a mechanism intended to receive a stick of cosmetic product. The mechanism is received in the base cover. The mechanism has a base, a tube and a cup. The mechanism is designed to move the cup and, thus, the stick of cosmetic product, in the tube with respect to the base, between a retracted position, of closure of the packaging device, and an extended position, of application of the cosmetic product. In this type of device, the stick of cosmetic product is generally moved between its two positions, by pivoting the tube with respect to the base of the mechanism, the base having a helical groove for guiding at least one protuberance rigidly secured to the cup rotated with respect to the base via the tube.

Application FR-A-2 662 921 describes an example of such a device for packing and applying a cosmetic product.

However, a cosmetic product in stick form generally comprises one or more volatile components, such as solvents for example. These volatile components are likely to evaporate in the packaging and application device, which is detrimental to the life span of the cosmetic product.

To limit this evaporation of the volatile components of the cosmetic product, EP-A-1 197 162 describes a packaging and application device in which the cap is provided with an internal sleeve, which is elastically deformable, having a relief complementing a relief formed by an insert in the base of the packaging and application device. This insert is received between the cover of the base of the packaging and application device and the base of the mechanism. A complementarity of the shape of the reliefs is implemented between the tube of the mechanism and the cover of the cap of the packaging and application device to ensure the seal-tightness. However, in this case, a trade-off is required as to the material used to form this internal sleeve. Indeed, while the aim of the relief complementing the relief formed by the insert is to obtain a seal-tightness, which requires a certain flexibility, the aim of the internal sleeve is also to increase the mechanical strength of the cap. Moreover, when the cap is removed, the relief of the insert and the insert itself are visible along the tube of the mechanism. This is detrimental to the esthetics of the packaging and application device.

There is therefore a need for a packaging and application device that does not present at least some of the drawbacks of the prior art. In particular, there is a need for a packaging and application device that makes it possible to conserve the cosmetic product for a long time. Advantageously, the packaging and application device is nevertheless easy to recap. Also, the esthetic of the packaging and application device is preferably maintained.

BACKGROUND OF THE DISCLOSURE

To this end, the invention proposes a packaging and application device for a cosmetic product comprising:

- a mechanism intended to receive a stick of cosmetic product, the mechanism having a base, a tube and a cup for receiving the stick of cosmetic product, the mechanism being designed to move the cup with respect to the tube, between a retracted position, of closure of the packaging and application device, and an extended position, of application of the cosmetic product,
- a base cover, forming a first housing for receiving a first portion of the mechanism,
- a first seal inserted between an element of the base cover and an element of the mechanism, and
- a cap, adapted to be fixed onto the base cover to define a second housing receiving a second portion of the mechanism, a second seal being inserted between the cap and at least one out of said element of the base cover and said element of the mechanism, the first and second housings being linked in a seal-tight manner by said element of the base cover and/or said element of the mechanism.

Thus, advantageously, the device according to the invention proposes a dual seal that makes it possible to limit, and even prevent, the evaporation of the solvents and other volatile products of the cosmetic product out of the housings.

Moreover, the first and second housings being linked in a seal-tight manner, a volume is formed inside the packaging and application device which, in the closed state of the device, is seal-tight, thus preventing the evaporation of components of the cosmetic product.

Also, the positions of the first and second seals can advantageously be chosen so that these seals are not visible to a user, regardless of whether the packaging and application device is closed or open.

According to preferred embodiments, the packaging and application device according to the invention comprises one or more of the following features, taken alone or in combination:

- the base cover comprises a base cladding shell and a ferrule fixed onto the base cladding shell, the element of the base cover being preferably the ferrule;
- the base cover further comprises a base insert, the base insert being preferably received in the base cladding shell, inserted between the ferrule and the base of the mechanism, if necessary;
- one out of the first seal and the base insert is overmolded, notably overmolded by injection-molding, on the other out of the first seal and the base insert;
- the first seal is clamped against the ferrule and/or the element of the mechanism and/or the base insert, if necessary;
- the cap comprises a cover and a cap insert fixed in the cover, the cap insert at least partly defining the second housing;
- one out of the cap insert and the second seal is overmolded, in particular overmolded by injection-molding, on the other out of the cap insert and the second seal;

the second seal comprises a portion inserted, preferably clamped, between the cap insert and the element of the mechanism;

the cap further comprises a cap embellisher, fixed in the cover, preferably close to an outlet of the cap, the cap insert being preferably between the cover and the cap embellisher;

a portion of the second seal is inserted, preferably clamped, between the cap embellisher and the element of the mechanism;

the second seal further comprises a portion inserted, preferably clamped, between the cap embellisher and the cap insert;

the first seal and/or the second seal is/are made of one out of Hytrel® and Arnitel®;

the first seal and/or the second seal is/are domed toward the mechanism;

the packaging and application device has, in the closed state in which the cap is fixed to the base cover, an air passage through the mechanism between a first orifice emerging in the first housing and a second orifice emerging in the second housing;

the cup has a cylindrical shape that is open at both of its ends, a first end of the cup emerging in the first housing and a second end of the cup emerging in the second housing;

the element of the mechanism is the base of the mechanism; and the base of the mechanism comprises a bush forming a helical path for guiding the cup and a ring fixed on the base, said element of the mechanism being preferably the bush or the ring.

According to another aspect, a mechanism is described that is intended to receive a stick of cosmetic product, in particular for a packaging and application device as described above in all its combinations, the mechanism having a base, a tube and a cup, the cup being intended to receive the stick of cosmetic product, the cup having at least one relief of a section complementing the section of a helical groove in the base, the relief of the cup being received in the helical groove so that pivoting the tube with respect to the base of the mechanism causes a movement of the cup with respect to the tube between a retracted position and an extended position, of application of the cosmetic product, in which mechanism an air passage fluidically connects a first orifice in the mechanism with a second orifice in the mechanism.

The base can comprise a bush in which the helical groove is formed and a ring fixed to an end of the bush, the second orifice being in the ring or between the tube and the ring.

The first orifice can be in the bush or between the bush and the ring.

The bush can have longitudinal ribs on its outer surface, the air passage passing preferably at least partly between two longitudinal ribs.

The cup can have a cylindrical shape with radially inward protuberances for holding the stick of cosmetic product in position and at least one outward-protruding relief for guiding the cup in the helical groove in the base, the cup being open at both of its ends.

The tube can surround the cup, the tube being fixed in longitudinal translation with respect to the bush.

The tube can be secured in rotation to the cup, the tube preferably having two longitudinal slits passed through by the at least one relief of the cup, protruding outward to guide the cup in the helical groove in the base.

Also described is a packaging and application device as described above in all its combinations, in which the mechanism is as described above in all its combinations, the air passage fluidically connecting the first housing and the second housing.

DESCRIPTION OF THE DRAWINGS

The invention will be better understood from the following description, given in light of the attached drawings, in which.

DETAILED DESCRIPTION OF THE DISCLOSURE

Hereinafter in the description, the elements that are identical or have an identical function bear the same reference symbol in the various figures. For brevity in the present description, these elements are not described in detail with respect co each figure.

Figure 1:
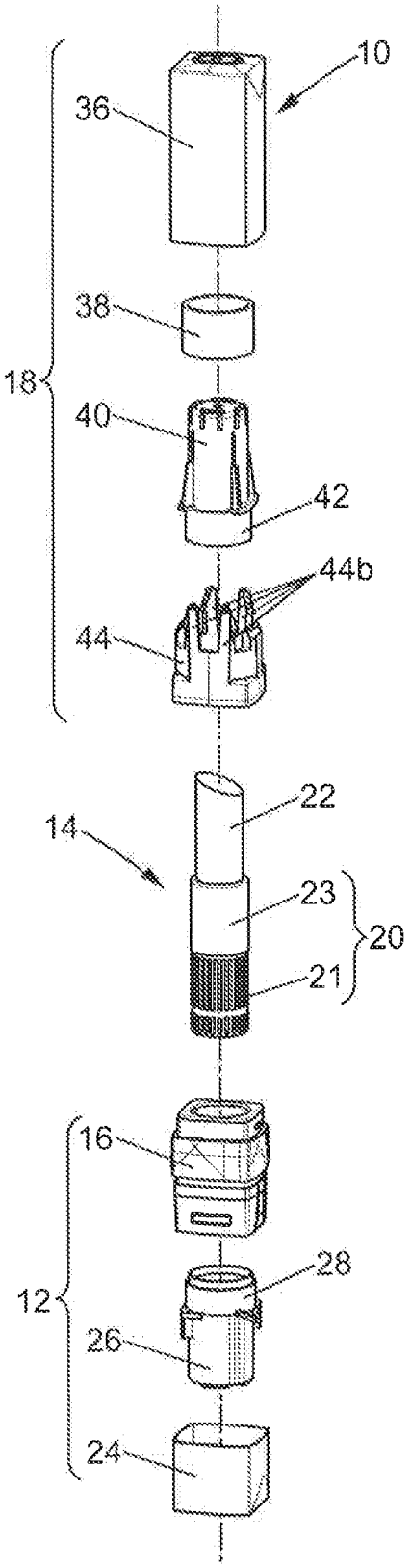
FIG. 1 is an exploded view of an example of a device for packaging and applying a cosmetic product.
Figure 2:
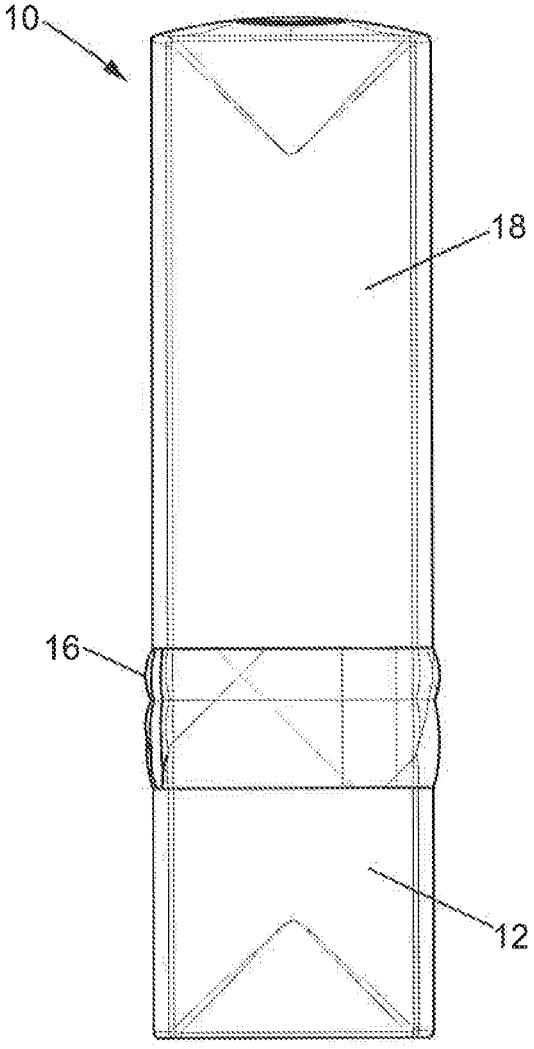
FIG. 2 illustrates the device for packaging and applying a cosmetic product of FIG. 1, in its closed state.
Figure 3:
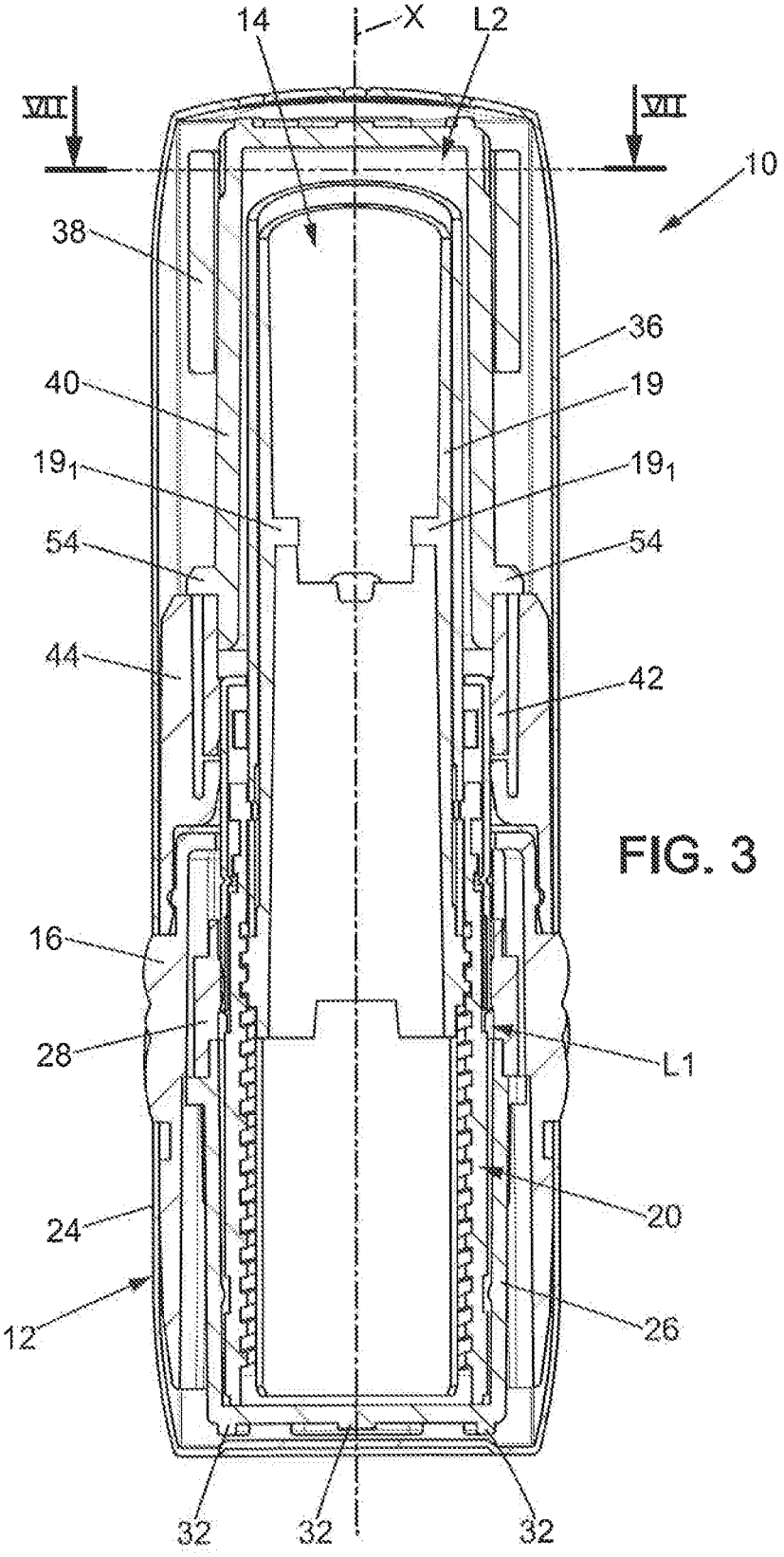
FIG. 3 is a cross-sectional view of the device for packaging and applying a cosmetic product of FIGS. 1 and 2.
Figure 4:
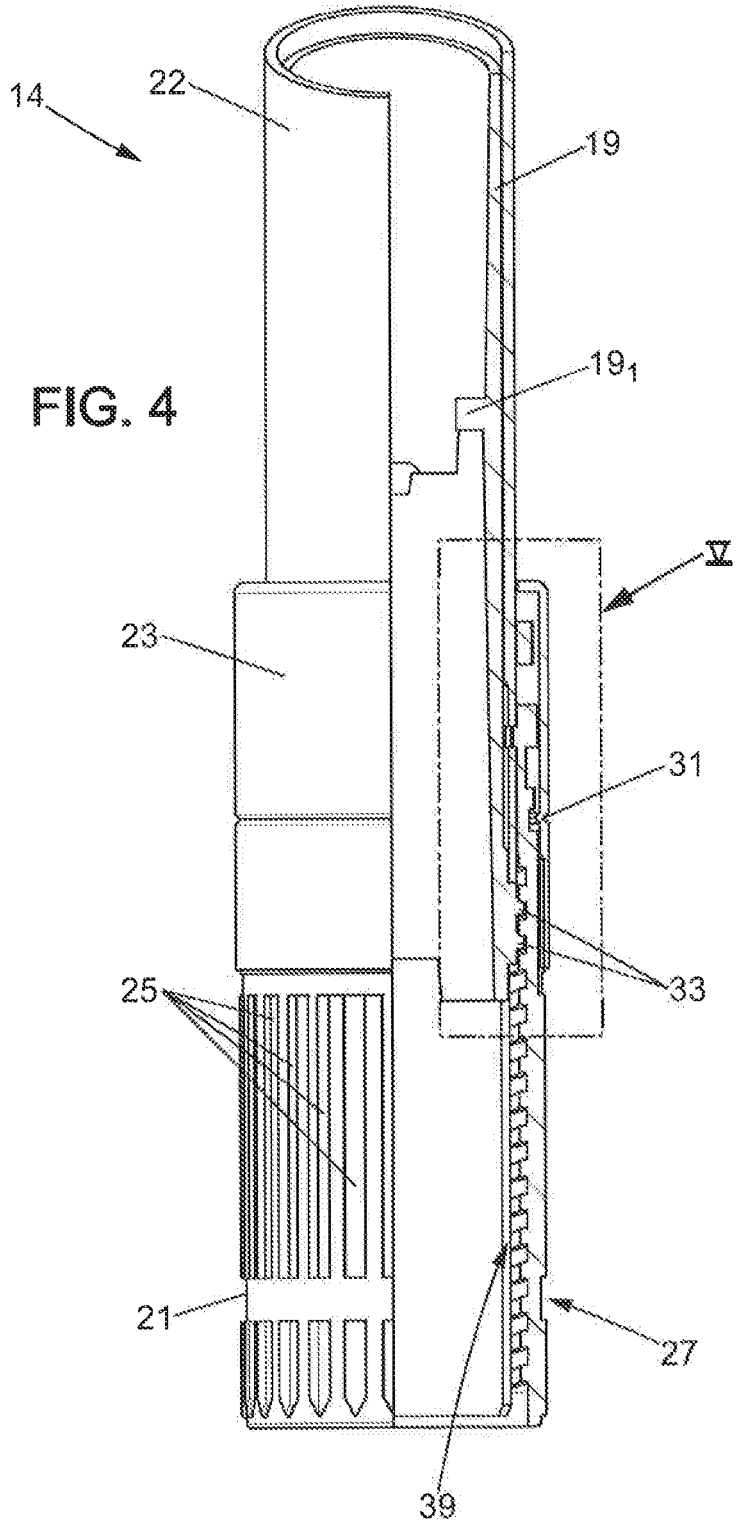
FIG. 4 is a partially cut-away view of the mechanism of the device for packaging and applying a cosmetic product of FIGS. 1 and 2.

FIGS. 1 to 3 show an example of a device 10 for packaging and applying a cosmetic product.

Here, the cosmetic product takes the form of a stick. The cosmetic product can notably be a lipstick, a color product, a skin- or lip-care product, in particular a lip balm, a sun protection product for the lips or the skin.

This packaging and application device 10 comprises, as is visible in FIG. 1, a base cover 12, a mechanism 14 and a cap 18. To close the packaging and application device 10, the cap 18 can be fixed onto the base cover 12, for example by elastic fitting (or snap fitting). In the example illustrated, the base cover 12 comprises a ferrule 16 which forms the interface with the cap 18. However, other means for fixing the cap 18 onto the base cover 12 are accessible to the person skilled in the art. Notably, the cap 18 can be screwed or tightly fitted onto the base cover 12, notably onto the ferrule 16. Also, when the base cover 12 comprises an element made of magnetic material, the cap 18 can be magnetized on this element of the base cover 12. This element of the base cover 12 can notably be the ferrule 16.

As is known per se, the mechanism 14 receives a stick of cosmetic product (not represented in the figures). The mechanism here comprises a base 20, a cup 19 and a tube 22. The mechanism 14 is designed to move the cup 19, to which the stick of cosmetic product is fixed, with respect to the tube 22, between a retracted position, allowing the closure of the packaging and application device 10, and an extended position, for application of the cosmetic product, in which the stick of cosmetic product protrudes from the tube 22. The retracted position allows the closure of the packaging and application device 10 by fixing the cap 18 onto the base cover 12, notably onto the ferrule 16.

In the example illustrated, the cup 19 has an essentially cylindrical shape that is open at both of its ends. The cup 19 does however have radially-inward protuberances 191 to hold the stick of cosmetic product in position in the cup 19. In the absence of a stick of cosmetic product, the two ends of the cylindrical part of the cup 19 are fluidically connected. In other words, the protuberances 19, preferably do not block the section of the cylindrical part of the cup 19. Furthermore, the cylindrical part of the cup 19 advantageously has no opening on its cylindrical surface, so that the two ends of the cylindrical part of the cup 19 are fluidically connected in a seal-tight manner.

The mechanism 14 of the packaging and application device 10 is described hereinbelow, with respect to FIGS. 3 to 6 in particular.

The base 20 of the mechanism 14 here comprises a bush 21 and a ring 23, fixed onto the bush 21. The ring 23 is for example made of metal. The ring 23 is for example obtained by stamping a metal sheet. The ring 23 also has no opening on its cylindrical lateral wall. Thus, the openings at the two longitudinal ends of the ring 23 are fluidically connected in a seal-tight manner inside the ring 23.

The bush 21 comprises, on its outer surface, ribs 25. Here, these ribs 25 are longitudinal. The ribs 25 are, here, rectilinear. The bush 21 also comprises, according to the example illustrated, a first circumferential groove 27 and a second circumferential groove 29. The second circumferential groove 29 receives a fold 31 of the ring 23 in order to axially fix the ring 23 onto the bush 21.

Moreover, the bush 21 has, on its inner surface, at least one helical groove 39. The cup 19 has at least one relief 33, preferably at least two reliefs complementing the section of the at least one helical groove 39, received in this at least one helical groove 39. Thus, the at least one helical groove 39 allows the cup 19 to be guided in a helical movement by pivoting the cup 19 with respect to the bush 21. In this particular case, the relief or reliefs 33 of the cup 19 extend through longitudinal slits made in the tube 22. Thus, the cup 19 is mounted securely in rotation with the tube 22. The tube 22 is fixed in longitudinal translation in the direction X, with respect to the bush 21.

Figure 5:
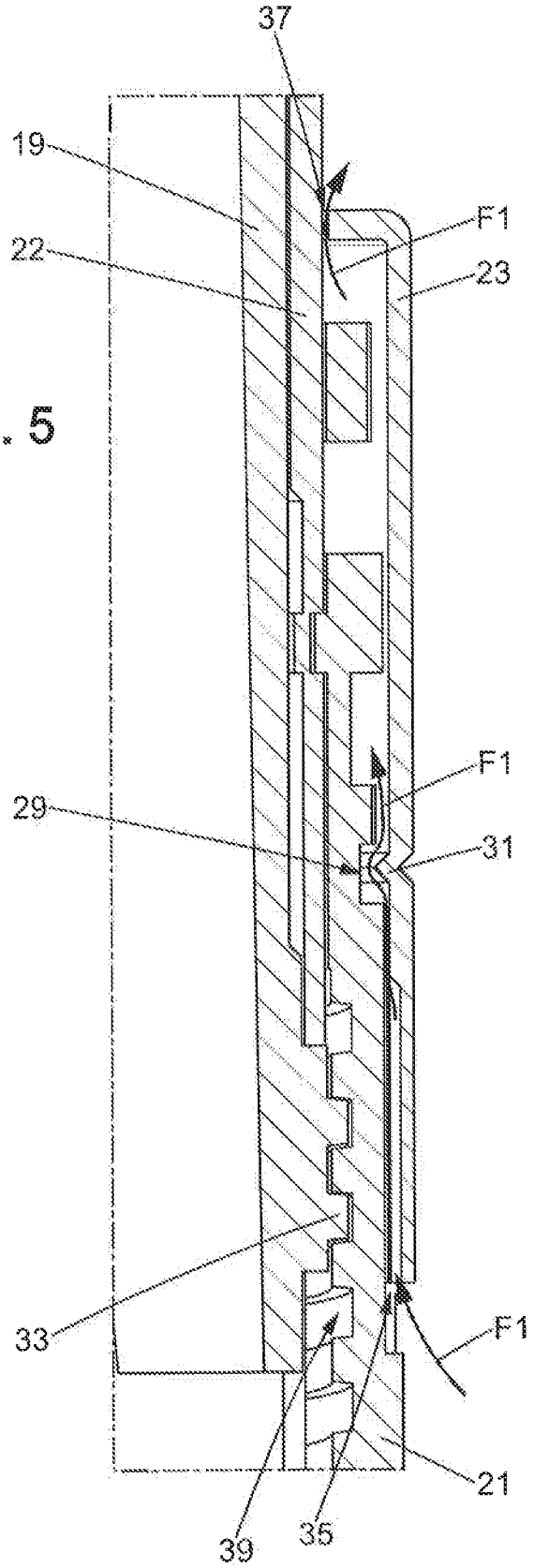
FIG. 5 represents an enlarged view of the detail V of FIG. 4.
Figure 6:
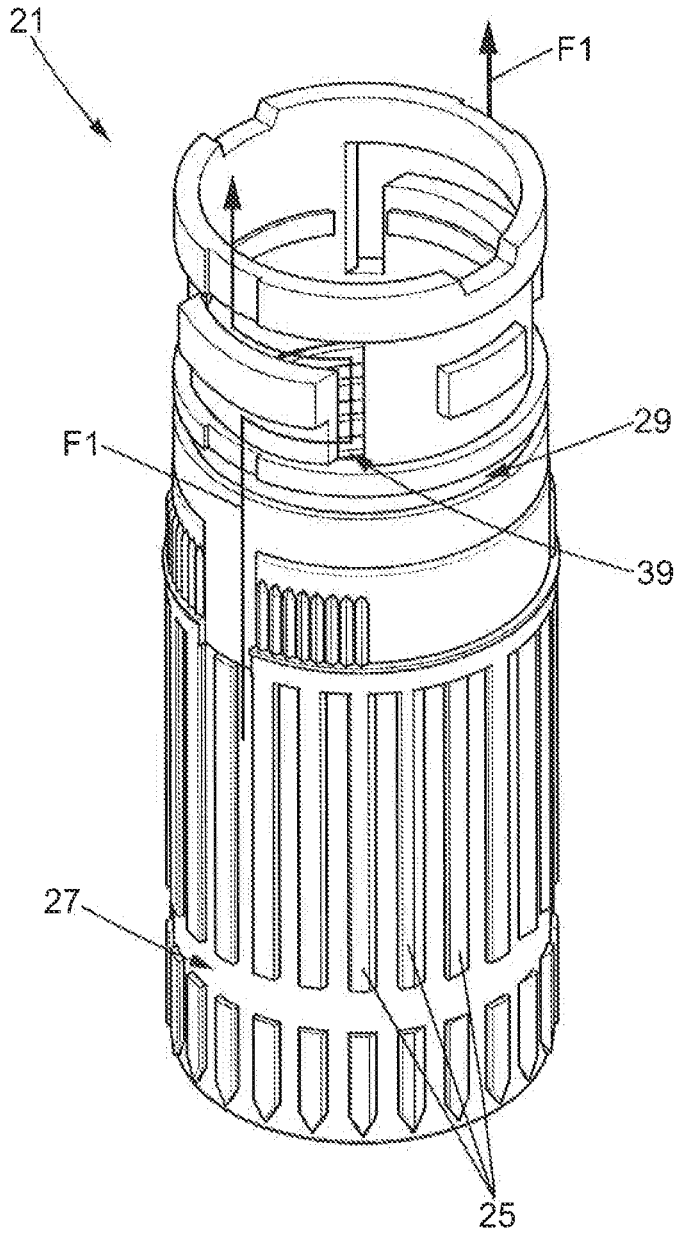
FIG. 6 is a perspective view of the bush of the mechanism of FIG. 4, illustrating the position of the air passage.

Notably, as is particularly visible in FIGS. 5 and 6, an air passage F1 (or leakage path) fluidically connects a first orifice 35 in the mechanism 14, here between the bush 21 and the ring 23, at a first end of the ring 23, with a second orifice 37 in the mechanism 14, at a second end of the ring 23, opposite the first end. Here, the second orifice 37 is situated between the ring 23 and the tube 22. Thus, air can flow freely between the first orifice 35 and the second orifice 37, through the mechanism 14. Notably, the air flows here between the bush 21 and the ring 23, first of all, then between the tube 22 and the ring 23. The ribs 25 on the outer surface of the bush 21, which also extend on the outer surface of the bush 21, covered by the ring 23, facilitate this circulation of air. Also, a notch can be made in the bush 21, at the first orifice 35 to facilitate the flow of air. The position of the air passage F1 with respect to the bush 21 is more clearly visible in FIG. 6.

The base 20 of the mechanism 14 is secured, notably secured in rotation, to the base cover 12. In particular, the bush 21 is secured in rotation to the base cover 12, whereas the cup 19 and the tube 22 can pivot together with respect to the base cover 12. Thus, in the example illustrated, the stick of cosmetic product can be brought out by pivoting the tube 22 with respect to the base cover 12.

Moreover, the base cover 12 of the packaging and application device 10 forms a housing L1 for receiving a portion of the base 20 of the mechanism 14. The base cover 12 is, here, fixed to the base 20 of the mechanism 14 so that the base cover 12 and the base 20 of the mechanism are secured in rotation about a longitudinal axis X of the packaging and application device 10.

In the example illustrated, the base cover 12 is essentially formed by a base cladding shell 24, the ferrule 16 and a base insert 26, received and fixed in the base cladding shell 24. Here, the housing L1 for receiving a portion of the base 20 is mostly defined by the base insert 26. The base insert 26 is held fixed in the cladding shell 24 for example by snap-fitting, fitting or gluing. Here, the base 20 of the mechanism 14 is received tightly in the base insert 26. Furthermore, the circumferential groove 27 on the outer surface of the bush 21 can receive one or more reliefs protruding on the radially inner surface of the base insert 26, so as to ensure that the base 20 of the mechanism 14 and the base insert 26 are held in relative longitudinal position.

As is more particularly visible in FIG. 3, a first seal 28 is inserted between the ferrule 16 of the base cover 12, and the ring 23 of the base 20 of the mechanism 14. In particular, the first seal 28 is clamped against the ring 23 of the base 20 of the mechanism 14. Evaporation of the volatile components involved in the composition of the cosmetic product, along the base of the mechanism 20, between the insert 26 and the base 20 of the mechanism 14, to the outside of the device 10, is thus limited, even avoided.

The base insert 26 is described hereinbelow in more detail, notably with respect to FIGS. 8 to 11. As is visible in these figures, the base insert 26 has an essentially cylindrical bush form, open on a single longitudinal side, where the base insert 26 is in contact with the first seal 28. Contact between the base insert 26 and the first seal 28 is, for example, obtained by chemical adhesion between the materials forming the base insert 26 and the first seal 28. The base insert 26 has ribs 30 on its inner cylindrical face **26*i*. These ribs 30 are, here, longitudinal. Here, the ribs 30 are substantially rectilinear. The ribs 30 allow the base 20 of the mechanism 14 and the base insert 26 in which the base 20 of the mechanism 14 is received to be secured in rotation. Notably, the ribs 30 prevent a relative rotation of the bush 21 of the mechanism 14 with respect to the base insert 26, about the longitudinal axis X of the packaging and application device 10. As can be seen notably in FIGS. 8 and 11, in the example described, the base insert 26 has twelve ribs 30. Advantageously, the ribs 30 are evenly distributed angularly on the inner cylindrical face 26***i* of the base insert 26.

On its bottom face 26*inf*, the base insert 26 has studs 32. The base insert 26 has, for example, six studs on its bottom face 26*inf*. The studs 32 are advantageously evenly distributed angularly. The studs 32 are advantageously situated close to the edge of the bottom face 26*inf* of the base insert 26. The studs 32 facilitate the reception of the base insert 26, flat on the bottom of the base cladding shell 24. The studs 32 here have a substantially rectangular parallelepipedal shape. However, the studs 32 can take other shapes.

It will be noted that the bottom surface 26*inf* is the base surface of the bush formed by the base insert 26, that is to say its longitudinal end surface, opposite its opening.

Moreover, the base insert 26 has, on its outer cylindrical surface 26*e*, substantially at the opening, protruding reliefs 34, of substantially triangular shape. Here, three such reliefs 34 are produced. These reliefs 34 are angularly separated by an angle of substantially 90°. These reliefs 34 are intended to wedge the base insert 26 in the base cover 12 for example via the ferrule 16, which has a housing for receiving the base insert 26 of substantially complementary section. Complementary section is understood here to mean a section allowing a fixing by complementarity of shapes. These reliefs thus make it possible to prevent a relative rotation of the base insert 26 with respect to the base cover 12 about the longitudinal axis X of the packaging and application device 10. Thus, the rotation of the base cover 12 is transmitted to the bush 21 of the mechanism 14 via the base insert 26.

Figure 8:
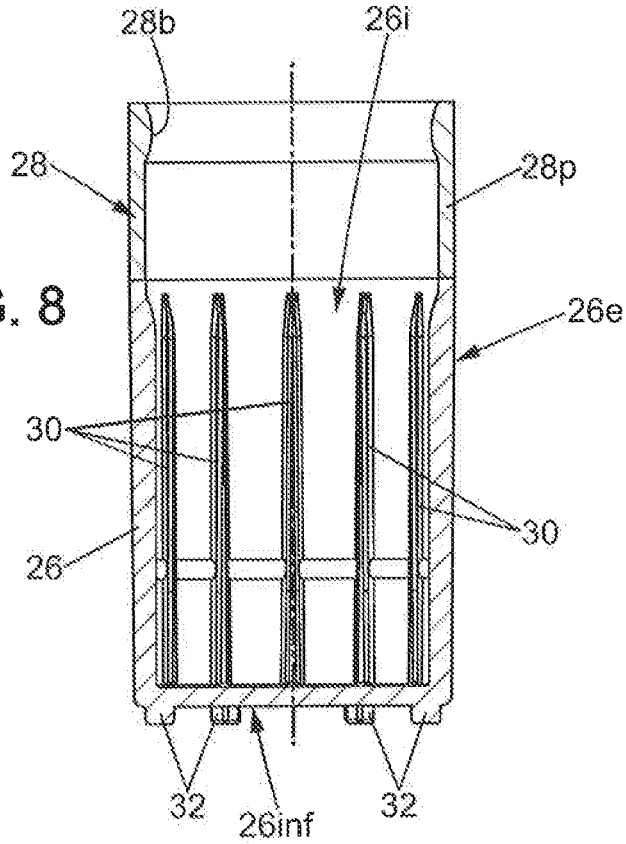
FIG. 8 is a cross-sectional view along plane VIII-VIII of the assembly formed by the base insert and the first seal of the device for packaging and applying a cosmetic product of FIG. 1.
Figure 9:
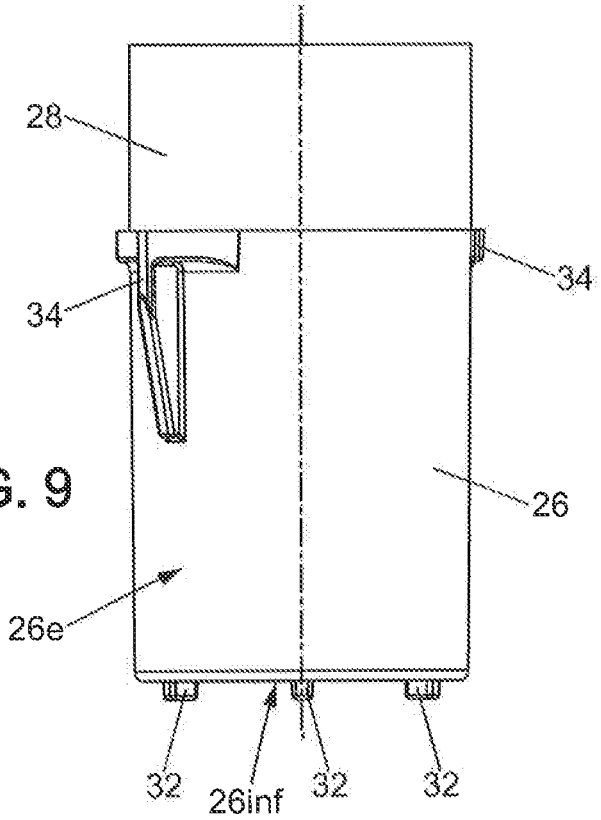
FIG. 9 schematically represents the assembly formed by the base insert and the first seal of FIG. 8, seen from the side.
Figure 10:
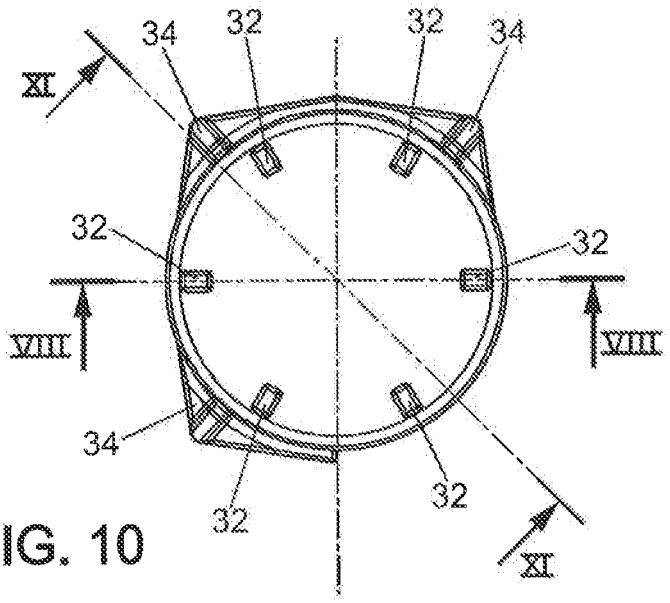
FIG. 10 schematically illustrates a view from below of the assembly formed by the base insert and the first seal of FIG. 8.
Figure 11:
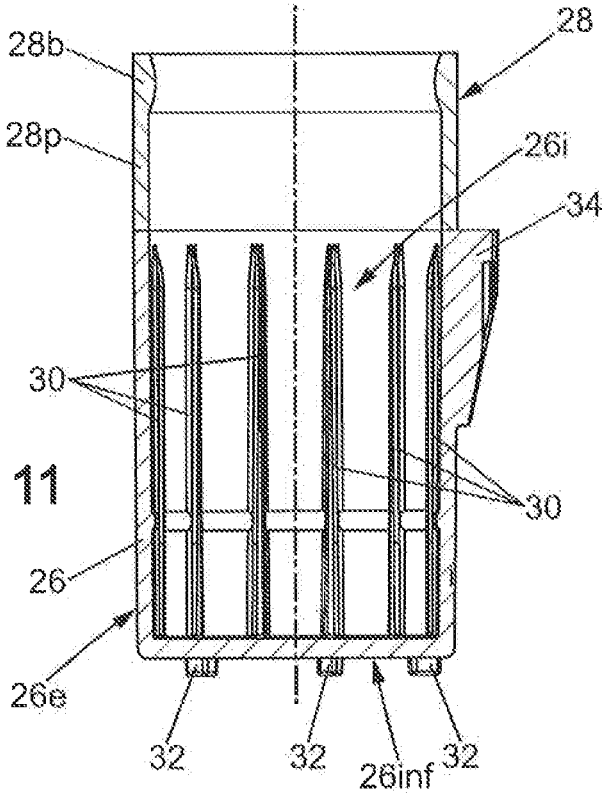
FIG. 11 is a cross-sectional view along plane XI-XI of the assembly formed by the base insert and the first seal of the device for packaging and applying a cosmetic product of FIG. 1.
Figure 12:
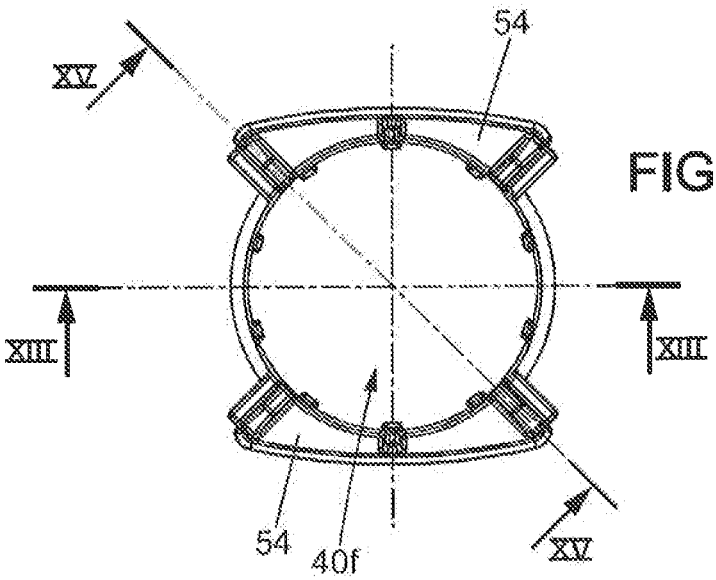
FIG. 12 is a plan view of the assembly formed by the cap insert and the second seal of the device for packaging and applying a cosmetic product of FIG. 1.
Figure 13:
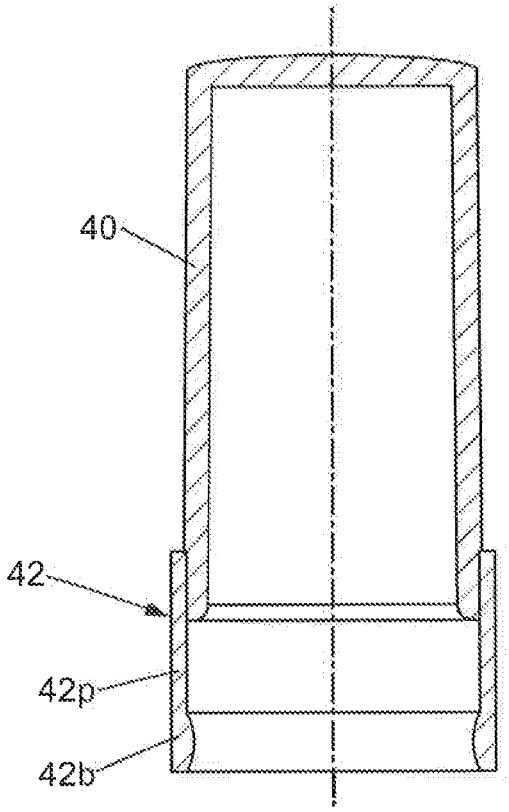
FIG. 13 is a cross-sectional view along plane XIII-XIII of the assembly formed by the cap insert and the second seal.

Moreover, as is visible notably in FIGS. 8, 9 and 11, the first seal 28 is, here, secured to the base insert 26. Advantageously, in fact, the first seal 28 is overmolded, for example by injection-molding, on the base insert 26, or the base insert 26 is overmolded, for example by injection-molding, on the first seal 28.

This first of all makes it possible to rigidly fix the first seal 28 to the base insert 26. Thus, when assembling the packaging and application device 10, there is only one piece to be handled, corresponding to the assembly consisting of the base insert 26 and of the first seal 28. This overmolding also makes it possible to ensure the seal-tightness between the first seal 28 and the base insert 26. The overmolding also allows different materials to be used for the base insert 26 and the first seal 28, the base insert 26 being, for example, made of a more rigid material than the material from which the first seal is made.

Alternatively, the first seal 28 and the base insert are made as a single piece, of one and the same material. In this case, the first seal 28 and the base insert 26, as a single piece, can be made of thermoplastic material or metal, for example aluminum or ZAMAC alloy.

Also alternatively, the first seal 28 can be borne independently on the base insert 26, the first seal 28 and the base insert 26 then being two distinct pieces. The first seal 28 and the base insert 26 can then be assembled together, possibly reversibly.

It should be noted here that the base insert 26 extends only on one longitudinal side of the first seal 28. However, as a variant, the base insert 26 can extend on either side of the first seal 28, in the longitudinal direction X of the packaging and application device 10. In this case, the first seal 28 forms a ring held captive in the base insert 26. Such a configuration can notably be obtained by overmolding, for example by injection-molding, the base insert 26 on the first seal 28.

The first seal 28 here has a main portion 28*p* of tubular, preferably cylindrical, shape. At the free end of the main portion 28*b*, the seal 28 forms a bead 28*b*. Here, the bead 28*b* is oriented radially inward.

In the example illustrated in FIGS. 1 and 3, notably, the ferrule 16 covers the first seal 28. Thus, the first seal 28 is concealed from a user by virtue of the presence of the ferrule 16. The esthetic appearance of the packaging and application device 10 is thereby preserved.

Moreover, as is visible in FIG. 1, notably, the cap 18 here comprises a cap cover 36, a weight 38, a cap insert 40 and a cap embellisher 44. A second seal 42 is mounted in the cap 18.

Advantageously, the second seal 42 is overmolded, for example by injection-molding, on the cap insert 40, or the cap insert 40 is overmolded, for example by injection-molding, on the second seal 42. It is thus possible to easily fix the second seal 42 to the cap insert 40, which makes it possible to handle only one piece when assembling the packaging and application device 10. Furthermore, the seal-tightness of the contact between the second seal 42 and the cap insert 40 is thus assured.

According to a variant that is not illustrated, in the case where the cap insert 40 is overmolded on the second seal 42, the cap insert 40 can extend longitudinally on either side of the second seal 42.

According to another variant that is not illustrated, the cap insert 40 and the second seal 42 are a single piece and made of one and the same material. In this case, the second seal 42 and the cap insert 40, as a single piece, can be made of thermoplastic material or a metal, for example aluminum or ZAMAC alloy.

Also alternatively, the second seal 42 can be borne independently on the cap insert 40, the second seal 42 and the cap insert 40 then forming two distinct pieces. The second seal 42 and the cap insert 40 can then be assembled together, possibly reversibly.

As illustrated, the cap cover 36 has a bush form, closed at one end. The cap cover 36 has an essentially esthetic function. The cross section of the cap cover 36 is, here, substantially square. However, the cross section of the cap cover 36 can also be round or take any other shape, notably a polygonal shape.

Figure 7:
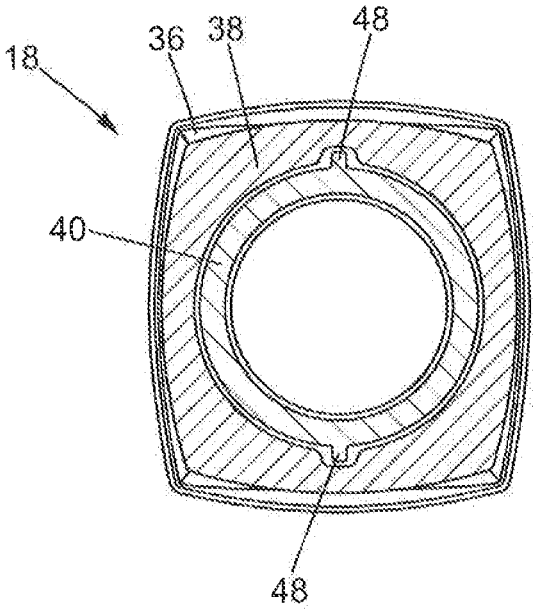
FIG. 7 is a cross-sectional view along plane VII-VII of the device for packaging and applying a cosmetic product of FIG. 1.

The weight 38 is fixed inside the cap cover 36. To do this, for example, the cap cover 36 is overmolded on the weight 38 or, conversely, the weight 38 is molded in the cap cover 36. Also alternatively, the weight 38 can be fixed for example by gluing in the cap cover 36. The weight 38 advantageously has an annular shape. Here, the outer section of the weight 38 is of substantially square shape, matched to the section of the cover 36, whereas the internal section of the weight 38 is of substantially circular shape, suitable for receiving the cap insert 40, as is particularly visible in FIG. 7.

The cap embellisher 44 is used to close the housing inside the cover 36 so as to hold the weight 38, the cap insert 40 and the second seal 42 in position with respect to the cap cover 36 and to the cap embellisher 44. The cap embellisher 44 here has elastically deformable arms 44*b* to allow the cap embellisher 44 to be fixed onto the cap insert 40, by elastic fitting (or snap-fitting). The cap embellisher 44 also covers the second seal 42, so as to conceal the second seal 42 from a user. The esthetic appearance of the packaging and application device 10 is thereby enhanced.

The cap insert 40 and the second seal 42 are more clearly represented in FIGS. 12 to 15.

Figure 14:
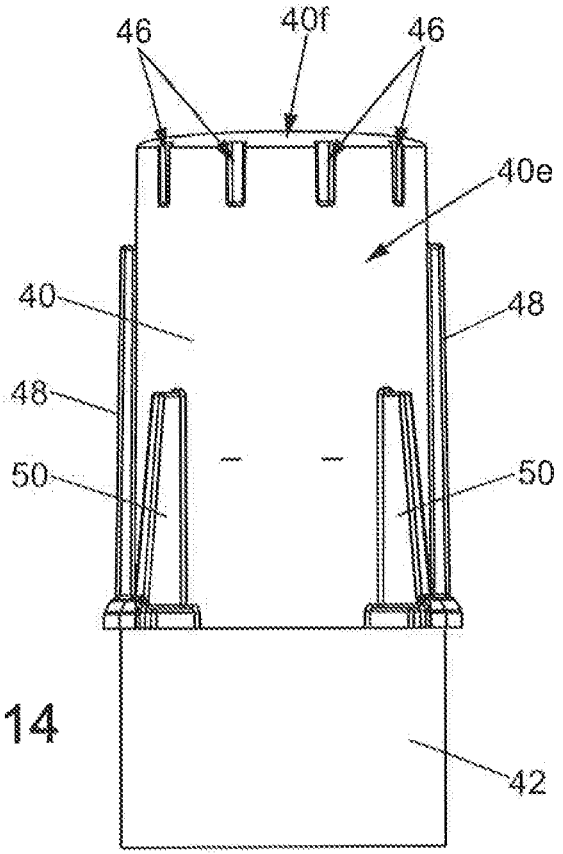
FIG. 14 schematically illustrates the assembly formed by the cap insert and the second seal of FIG. 12, seen from the side.
Figure 15:
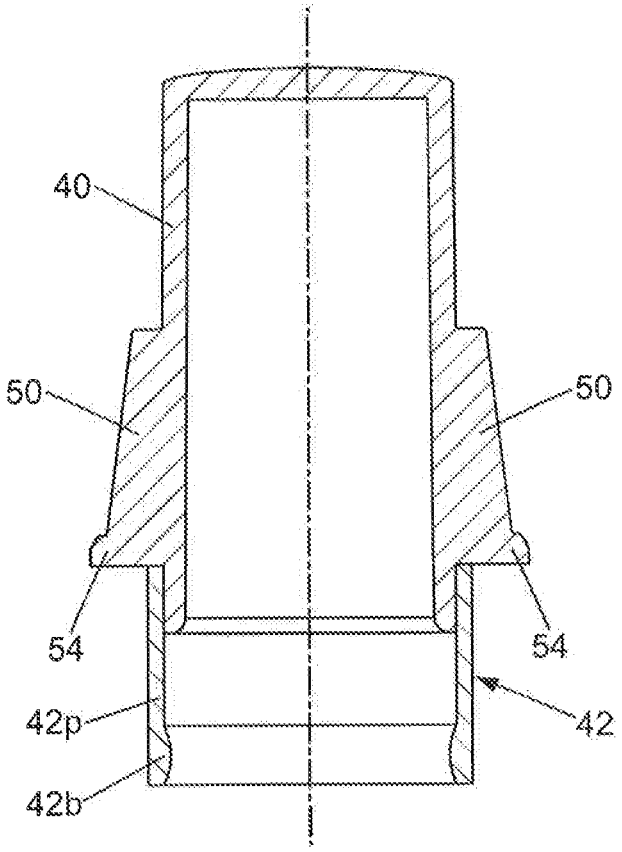
FIG. 15 is a cross-sectional view along plane XV-XV of the assembly formed by the cap insert and the second seal of FIG. 12.

As illustrated notably in FIG. 14, the cap insert 40 has, on its outer lateral surface 40*e*, notches 46. Here, these notches 46 are substantially longitudinal. The notches 46 emerge also on the bottom surface 40*f* of the cap insert 40. According to the example illustrated, the cap insert 10 has eight notches 46. The notches 46 are evenly distributed angularly. The notches 46 can cooperate with complementary protruding reliefs, formed on the bottom of the cover 36, to secure the cap insert 40 and the cover 36 in rotation on the longitudinal axis X. Also, or alternatively, the notches 46 facilitate the fixing of the weight 38 by clamping on the cap insert 40.

The cap insert 40 also has two longitudinal ribs 48 on its outer lateral face 40*e*. Here, the two longitudinal ribs 48 are opposite, produced at 180° from one another. These ribs 48 can notably allow the cap insert 40 to be guided in the cap cover 36 and/or in the weight 38 during its introduction, for example by cooperation with complementary grooves produced on the inner face of the cap cover 36 and/or in the weight 38. The two longitudinal ribs 48 also allow, by complementarity of shapes, the cover 36, the weight 38 and the cap insert 40 to be secured in rotation. Furthermore, in the example illustrated, a movement of the weight 38 toward the opening of the cap 36 is prevented by the presence of protruding reliefs 50 on the radially outer surface of the cap insert 40.

Set back from its outlet, the cap insert 40 forms protruding reliefs 54, extending radially outward to give the cap insert 40 a section substantially complementing the internal section of the cover 36. It is thus possible to fix the cap insert 40 in the cover 36 by complementarity of shapes.

Moreover, in the example illustrated, the second seal 42 comprises a substantially tubular, preferably cylindrical, main part 42*p*. In particular, the main part 42*p* is substantially cylindrical with symmetry of revolution. The main part 42*p* of the second seal 42 is for example disposed around the end portion of the cap insert 40. The main part 42*p* can notably be disposed around the end portion of the cap insert 40, so as to be in contact with the reliefs 54. A portion of the main part 42*p* can be clamped against the cap insert 40 and/or against the cap embellisher 44.

At its end opposite the cap insert 40, the main part 42*p* of the second seal 42 forms a radially-inward bead 42*b*. The corresponding portion of the main portion 42*p*, where the bead 42*b* is produced, is inserted between the base 20 of the mechanism 14 and the cap embellisher 44, and is in particular clamped against the ring 23 of the base 20 of the mechanism 14.

Evaporation of the volatile products involved in the composition of the cosmetic product, along the tube 22 of the mechanism 14, inside the cap insert 40, then, possibly, along the base 20 of the mechanism 14 toward the outside of the device 10, is thus limited, even avoided.

The first seal 28 and/or the second seal 42 can notably be made of one out of Hytrel® and Arnitel®. The base and cap inserts can notably be made of PCTA (polycyclo-hexylene dimethylene terephthalate acid).

In the example which has just been described, advantageously, the purpose of the first seal 28 is to ensure the seal-tightness of a first housing L1, defined in the base insert 26, preventing evaporation of the components of the cosmetic product through the cup 19, between the bush 21 and the base insert 26, then along the bush 21 and/or the ring 23, to the outside of the device 10. For this, here, the first seal 28 is, on the one hand, clamped on the ring 23 of the base 20 of the mechanism 14, and, on the other hand, overmolded on the base insert 26.

Similarly, the purpose of the second seal 42 is to ensure the seal-tightness of a second housing L2, defined in the cap insert 40, thus preventing evaporation of components of the cosmetic product from the cup 19, then between the tube 22 and the cap insert 40, to the outside of the device 10. Here, for this, the first seal 42 is, on the one hand, clamped on the ring 23 of the base 20 of the mechanism 14, and, on the other hand, overmolded on the cap insert 40.

The ring 23 links the first and second housings L1, L2 in a seal-tight manner. In the closed state of the packaging and application device, a volume receiving the stick of cosmetic product is thus defined, this volume being seal-tight.

In other words, here, the volume defined by the base insert 26, the first seal 28, the ring 23, the second seal 42 and the cap insert 40 constitutes a volume that is seal-tight with respect to the outside and that contains notably the stick of product.

However, having achieved seal-tightness of the housings L1, L2, a "piston effect" can occur when the packaging and application device 10 is closed. This "piston effect" can cause movement of the stick of product in the cup by creation of a pressure difference at the two ends of the stick of cosmetic product.

This piston effect is avoided in the example described above by virtue of the presence of the air passage F1 in the mechanism 14 which fluidically connects the first and second housings L1, L2. Thus, air can circulate between these two housings L1, L2, ensuring a substantially identical pressure in the two housings L1, L2. Here, the air passage F1 extends more specifically between the ring 23 and the bush 21. Thus, despite this air passage F1, the housings L1, L2 and the ring 23 do indeed define a volume, inside the packaging and application device, which is seal-tight with respect to the outside.

In the present case, the two ends of the cup 19 emerge in a respective housing L1, L2. Thus, advantageously, a substantially identical pressure is ensured between the two opposite surfaces of the stick of cosmetic product, received in the cup 19.

Furthermore, the air is not trapped in one or other of the two housings L1, L2, but can, on the contrary, flow from one of the housings to the other. The stresses on the stick of product are therefore distributed on each side of the stick.

In the example illustrated, it is the assembly formed by the first and second housings L1, L2 and the air passage F1 which constitutes a seal-tight volume, in the closed state of the packaging and application device 10, with respect to the outside of the packaging and application device 10, by virtue of the presence and the position of the first and second seals 28, 42.

The invention is not limited to just the embodiments described hereinabove with respect to the figures, but does, on the contrary, lend itself to numerous variants accessible to the person skilled in the art.

First of all, the second seal 42 can comprise an annular portion, extending radially inward from the main part. This annular portion can advantageously be clamped against the lip, around the outlet of the cap insert, and/or against the base of the mechanism.

Moreover, in the example described, the first and second seals form beads. Alternatively or in addition, the first seal and/or the second seal is/are domed toward the mechanism. This enhances the effect of these seals.

Also, the positions of the first and second seals can be different, as long as the seals are clamped against one and the same element of the mechanism and/or one and the same element of the base cover, this element of the mechanism and/or this element of the base cover linking, in a seal-tight manner, the first and second housings. The element of the base cover can notably be the ferrule, as in the example described above, or the base cladding shell. The element of the mechanism can notably be the bush, the ring or the tube of the mechanism.

The invention claimed is:

1. A packaging and application device for a cosmetic product comprising:

a mechanism intended to receive a stick of cosmetic product, the mechanism having a base, a tube and a cup for receiving the stick of cosmetic product, the mechanism being designed to move the cup with respect to the tube, between a retracted position, of closure of the packaging and application device, and an extended position, of application of the cosmetic product, a base cover, forming a first housing for receiving a first portion of the mechanism, a first seal inserted between an element of the base cover and an element of the mechanism, and a cap, adapted to be fixed onto the base cover to define a second housing receiving a second portion of the mechanism, a second seal being inserted between the cap and at least one out of said element of the base cover and said element of the mechanism, the first and second housings being linked in a seal-tight manner by at least one of said element of the base cover and said element of the mechanism.

2. The packaging and application device as claimed in claim 1, wherein the base cover comprises a base cladding shell and a ferrule fixed onto the base cladding shell.

3. The packaging and application device as claimed in claim 2, wherein the base cover further comprises a base insert.

4. The packaging and application device as claimed in claim 3, wherein one out of the first seal and the base insert is overmolded on the other out of the first seal and the base insert.

5. The packaging and application device as claimed in claim 2, wherein the first seal is clamped against at least one of the ferrule and the element of the mechanism.

6. The packaging and application device as claimed in claim 1, wherein the cap comprises a cover and a cap insert fixed in the cover, the cap insert at least partly defining the second housing.

7. The packaging and application device as claimed in claim 6, wherein one out of the cap insert and the second seal is overmolded on the other out of the cap insert and the second seal.

8. The packaging and application device as claimed in claim 6, wherein the second seal comprises a portion inserted between the cap insert and the element of the mechanism.

9. The packaging and application device as claimed in claim 6, wherein the cap further comprises a cap embellisher, fixed in the cover.

10. The packaging and application device as claimed in claim 9, wherein a portion of the second seal is inserted between the cap embellisher and the element of the mechanism.

11. The packaging and application device as claimed in claim 9, wherein one out of the cap insert and the second seal is overmolded on the other out of the cap insert and the second seal and wherein the second seal further comprises a portion inserted between the cap embellisher and the cap insert.

12. The packaging and application device as claimed in claim 1, wherein at least one among the first seal and the second seal is made of one out of Hytrel® and Arnitel®.

13. The packaging and application device as claimed in claim 1, wherein at least one among the first seal and the second seal is domed toward the mechanism.

14. The packaging and application device as claimed in claim 1, having, in the closed state in which the cap is fixed to the base cover, an air passage through the mechanism between a first orifice emerging in the first housing and a second orifice emerging in the second housing.

15. The packaging and application device as claimed in claim 1, wherein the cup has a cylindrical shape open at both of its ends, a first end of the cup emerging in the first housing and a second end of the cup emerging in the second housing.

16. The packaging and application device as claimed in claim 1, wherein the element of the mechanism is the base of the mechanism.

17. The packaging and application device as claimed in claim 1, wherein the base of the mechanism comprises a bush forming a helical guiding path for the cup and a ring fixed onto the base, said element of the mechanism being the bush or the ring.

18. A mechanism intended to receive a stick of cosmetic product, the mechanism having a base, a tube and a cup, the cup being intended to receive the stick of cosmetic product, the cup having at least one relief of a section complementing the section of a helical groove in the base, the relief of the cup being received in the helical groove so that pivoting the tube with respect to the base of the mechanism causes a movement of the cup with respect to the tube between a retracted position and an extended position, of application of the cosmetic product, in which mechanism an air passage fluidically connects a first orifice in the mechanism with a second orifice in the mechanism.

19. The mechanism as claimed in claim 18, wherein the base comprises a bush in which the helical groove is formed, and a ring fixed to an end of the bush, the second orifice being in the ring or between the tube and the ring.

20. The mechanism as claimed in claim 19, wherein the first orifice is in the bush or between the bush and the ring.

21. The mechanism as claimed in claim 18, wherein the bush has longitudinal ribs on its outer surface.

22. The mechanism as claimed in claim 18, wherein the cup has a cylindrical shape with radially inward protuberances for holding the stick of cosmetic product in position, and at least one outward-protruding relief for guiding the cup in the helical groove in the base, the cup being open at both of its ends.

23. The mechanism as claimed in claim 18, wherein the tube surrounds the cup, the tube being fixed in longitudinal translation with respect to the bush.

24. The mechanism as claimed in claim 23, wherein the tube is secured in rotation to the cup.

25. The packaging and application device as claimed in claim 1, wherein the mechanism is intended to receive a stick of cosmetic product, the mechanism having a base, a tube and a cup, the cup being intended to receive the stick of cosmetic product, the cup having at least one relief of a section complementing the section of a helical groove in the base, the relief of the cup being received in the helical groove so that pivoting the tube with respect to the base of the mechanism causes a movement of the cup with respect to the tube between a retracted position and an extended position, of application of the cosmetic product, in which mechanism an air passage fluidically connects a first orifice in the mechanism with a second orifice in the mechanism, the air passage fluidically connecting the first housing and the second housing.

* * * * *